US009353931B2

(12) United States Patent
Kim et al.

(10) Patent No.: US 9,353,931 B2
(45) Date of Patent: May 31, 2016

(54) LIGHTING DEVICE

(75) Inventors: Jin Wook Kim, Seoul (KR); Ji Hwan Jeon, Seoul (KR); Sang Jun Hong, Seoul (KR); Young Kuk Kwak, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 94 days.

(21) Appl. No.: 14/131,000

(22) PCT Filed: Jul. 13, 2012

(86) PCT No.: PCT/KR2012/005619

§ 371 (c)(1),
(2), (4) Date: Apr. 7, 2014

(87) PCT Pub. No.: WO2013/012217

PCT Pub. Date: Jan. 24, 2013

(65) Prior Publication Data

US 2014/0226305 A1 Aug. 14, 2014

(30) Foreign Application Priority Data

Jul. 15, 2011 (KR) ..... 10-2011-0070185
Jul. 26, 2011 (KR) ..... 10-2011-0073960

(51) Int. Cl.
*F21V 13/08* (2006.01)
*F21S 2/00* (2016.01)
(Continued)

(52) U.S. Cl.
CPC . *F21V 13/08* (2013.01); *F21S 2/00* (2013.01); *F21S 4/28* (2016.01); *F21S 8/03* (2013.01); *F21V 3/02* (2013.01); *F21V 3/049* (2013.01); *F21V 5/02* (2013.01); *F21V 7/00* (2013.01); *F21V 7/005* (2013.01); *F21V 7/0008* (2013.01); *F21V 13/02* (2013.01); *F21V 17/00* (2013.01); *F21V 3/04* (2013.01); *F21V 7/0025* (2013.01); *F21V 7/22* (2013.01); *F21V 9/16* (2013.01);
(Continued)

(58) Field of Classification Search
CPC ..... F21V 13/08; F21V 7/22
See application file for complete search history.

(56) References Cited

U.S. PATENT DOCUMENTS 5,530,628 A * 6/1996 Ngai ..... F21V 5/02 362/127
6,280,052 B1 * 8/2001 White ..... F21S 2/00 362/223

(Continued)

FOREIGN PATENT DOCUMENTS

CN 17103233 A 12/2005
CN 101994939 A 3/2011

(Continued)

OTHER PUBLICATIONS

European Search Report issued in Application No. 12815017.4 dated Mar. 4, 2015.

(Continued)

*Primary Examiner* — Elmito Breval
(74) *Attorney, Agent, or Firm* — Ked & Associates, LLP

(57) ABSTRACT

A lighting device may be provided that includes a housing; a coupling member coupled to the housing; a reflector disposed between the housing and the coupling member; a light source unit connected to the coupling member; and an optical member connected to the light source unit, wherein the optical member transmits a part of light emitted from the light source unit and reflects the other part of the light to the reflector.

20 Claims, 10 Drawing Sheets

(51) Int. Cl.

| | |
|---|---|
| ***F21V 7/00*** | (2006.01) |
| ***F21V 17/00*** | (2006.01) |
| ***F21S 8/00*** | (2006.01) |
| ***F21V 5/02*** | (2006.01) |
| ***F21V 3/02*** | (2006.01) |
| ***F21V 13/02*** | (2006.01) |
| *F21Y 103/00* | (2016.01) |
| *F21Y 101/02* | (2006.01) |
| *F21V 7/22* | (2006.01) |
| *F21Y 113/00* | (2016.01) |
| *F21V 3/04* | (2006.01) |
| *F21V 9/16* | (2006.01) |
| *F21V 13/12* | (2006.01) |

(52) U.S. Cl.
CPC ..... *F21V 13/12* (2013.01); *F21Y 2101/02* (2013.01); *F21Y 2103/003* (2013.01); *F21Y 2113/00* (2013.01)

(56) References Cited

U.S. PATENT DOCUMENTS

| | | | | |
|---|---|---|---|---|
| 6,655,819 | B2 * | 12/2003 | Loga | F21S 8/02 362/222 |
| 7,481,552 | B2 * | 1/2009 | Mayfield, III | F21S 8/04 362/223 |
| 7,520,636 | B2 * | 4/2009 | Van Der Poel | F21V 7/0008 362/290 |
| 7,901,105 | B2 * | 3/2011 | Fowler, Jr. | F21V 3/04 362/217.15 |
| 7,963,662 | B2 * | 6/2011 | Chung | F21S 8/02 362/147 |
| 8,100,551 | B2 * | 1/2012 | Mayfield, III | F21S 8/026 362/220 |
| 8,201,978 | B2 * | 6/2012 | Ladstatter | F21S 8/02 362/217.09 |
| 2005/0281023 | A1 | 12/2005 | Gould et al. | |
| 2005/0281024 | A1 * | 12/2005 | Mayfield, III | F21S 8/04 362/221 |
| 2006/0023450 | A1 | 2/2006 | Chung et al. | |
| 2007/0274081 | A1 | 11/2007 | Engel | |
| 2011/0222279 | A1 | 9/2011 | Kim et al. | |

FOREIGN PATENT DOCUMENTS

| | | | |
|---|---|---|---|
| DE | 4219742 | A1 | 12/1993 |
| DE | 10360945 | A1 | 7/2005 |
| EP | 0870977 | A2 | 10/1998 |
| EP | 1519103 | A1 | 3/2005 |
| KR | 10-2006-0036039 | A | 4/2006 |
| KR | 10-0756648 | B1 | 9/2007 |
| KR | 10-0883346 | B1 | 2/2009 |
| KR | 10-0904953 | B1 | 6/2009 |
| KR | 10-0931266 | B1 | 12/2009 |

OTHER PUBLICATIONS

Chinese Office Action issued in Application No. 201280035180.6 dated Mar. 16, 2015.
International Search Report dated Jan. 31, 2013 for corresponding International Application No. PCT/KR2012/005619.

* cited by examiner

LIGHTING DEVICE

CROSS-REFERENCE TO RELATED PATENT APPLICTIONS

The present application is a U.S national stage application under 35 U.S.C. 371 of PCT Application No. PCT/KR2012/005619, filed Jul. 13, 2012, which claims priority to Korean Patent Application No. 10-2011-0070185, filed Jul. 15, 2011, and Korean Patent Application No. 10-2011-0073960, filed Jul. 26, 2011, the entireties of which are incorporated herein by reference.

TECHNICAL FIELD

This embodiment relates to a lighting device.

BACKGROUND ART

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

DISCLOSURE

Technical Problem

The objective of the present invention is to provide a lighting device having a new structure.

The objective of the present invention is to provide a lighting device which is easy to replace and assemble.

The objective of the present invention is to provide a lighting device which is attachable to a conventional housing and has a lower manufacturing cost and weight.

The objective of the present invention is to provide a lighting device which provides indirect light as well as direct light.

The objective of the present invention is to provide a lighting device which has improved light efficiency.

Technical Solution

One embodiment is a lighting device. The lighting device includes: a housing; a coupling member coupled to the housing; a reflector disposed between the housing and the coupling member; a light source unit connected to the coupling member; and an optical member connected to the light source unit. The optical member transmits a part of light emitted from the light source unit and reflects the other part of the light to the reflector.

The optical member may include a first surface disposed under the light source unit and a second surface connecting the light source unit with the first surface. The first surface may transmit and reflect the light emitted from the light source unit. The second surface may transmit the light reflected from the first surface.

The second surface of the optical member may include at least one projection.

The first surface may include an extension part extending from both ends thereof. The extension part may extend longer than the projection.

The lighting device may further include a protective cover between the light source unit and the optical member. The optical member and the protective cover may include at least one of a lens, a diffusion sheet and a phosphor luminescent film (PLF).

The light source unit may include a body unit and a light emitting module disposed on the bottom surface of the body unit. The body unit may include a first body and a second body disposed on one side of the first body. The light emitting module may include a first light emitting module disposed on the first body and a second light emitting module disposed on the second body. The light source unit may further include a coupling cap coupling the first body to the second body.

The first body may be symmetrical. The first body may include a first projection, a second projection and a lower projection. The first projection projects outwardly from both upper sides of the first body. The second projection projects outwardly from both lower sides of the first body. The lower projection may project downwardly from both ends of the bottom surface of the first body.

The second projection may become closer to the top surface of the first body the farther it is from the first body.

The first projection may be formed shorter in the side direction of the light source unit than the second projection.

A wire connected to the light emitting module may be disposed in a wire path formed by the first projection and the second projection between the plural bodies.

A reflective material may be coated on at least some portions of the inner surface of the housing.

The coupling member may include an insertion groove. The light source unit may further include a connection member coupled to the insertion groove of the coupling member.

The coupling member may further include a first connection terminal in the insertion groove. The light source unit may further include a second connection terminal. The connection member of the light source unit is coupled to the insertion groove of the coupling member, so that the first connection terminal may be electrically connected to the second connection terminal.

The light source unit may include a body unit and a light emitting module. The body unit may include a first body and a second body. The connection member may include a first connection member disposed on the first body and a second connection member disposed on the second body. The lighting device may further include a spring between the first connection member and the second connection member.

Another embodiment is a lighting device. The lighting device includes: a housing which includes a coupling means; and a light source unit which extends in one direction of the housing and is coupled to the housing by a coupling means corresponding to the coupling means of the housing. The light source unit includes at least one body unit including a light emitting module.

The lighting device may further include at least one reflector which is disposed between the housing and the light source unit, and may further include an optical member which is coupled to the light source unit and transmits a part of light emitted from the light emitting module and reflects the other part of the light to the housing.

When the coupling means is a clip, the clip may be disposed on the inner upper surface of the housing and may have an opening, and the light source unit may be inserted into the opening of the clip and maybe coupled to the housing.

When the coupling means is a screw, at least one hole is formed on the top surface of the housing in one direction and at least one groove is formed on the top surface of the body unit. Then, the screw may pass through the hole of the housing and may be coupled to the groove of the body unit, so that the light source unit may be coupled to the housing.

The body unit may include at least one body. The body may be symmetrical and may further include a coupling cap coupling the bodies.

The lighting device may further include a protective cover between the body unit of the light source unit and the optical member. The optical member and the protective cover may include at least one of a lens, a diffusion sheet and a phosphor luminescent film (PLF).

Advantageous Effects

A lighting device in accordance with the present invention has a new structure.

A lighting device in accordance with the present invention is easy to replace and assemble.

A lighting device in accordance with the present invention is attachable to a conventional housing and has a lower manufacturing cost and weight.

A lighting device in accordance with the present invention provides indirect light as well as direct light.

A lighting device in accordance with the present invention has improved light efficiency.

DESCRIPTION OF DRAWINGS

Embodiments may be described in detail with reference to the following drawings in which like reference numerals refer to like elements and wherein.

MODE FOR INVENTION

Hereafter, an embodiment will be described in detail with reference to the accompanying drawings. However, it can be easily understood by those skilled in the art that the accompanying drawings are described only for easily disclosing the contents of the present invention and the scope of the present invention is not limited to those of the accompanying drawings.

A criterion for "on" and "under" of each layer will be described based on the drawings. A thickness or a size of each layer may be magnified, omitted or schematically shown for the purpose of convenience and clearness of description. The size of each component may not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

[An Embodiment]

Figure 1:
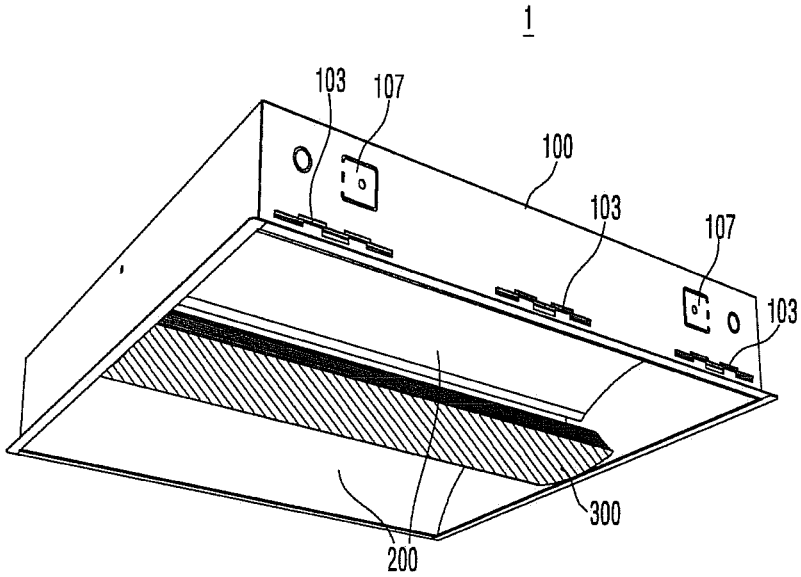
FIG. 1 is a perspective view of a lighting device according to an embodiment of the present invention.
Figure 2:
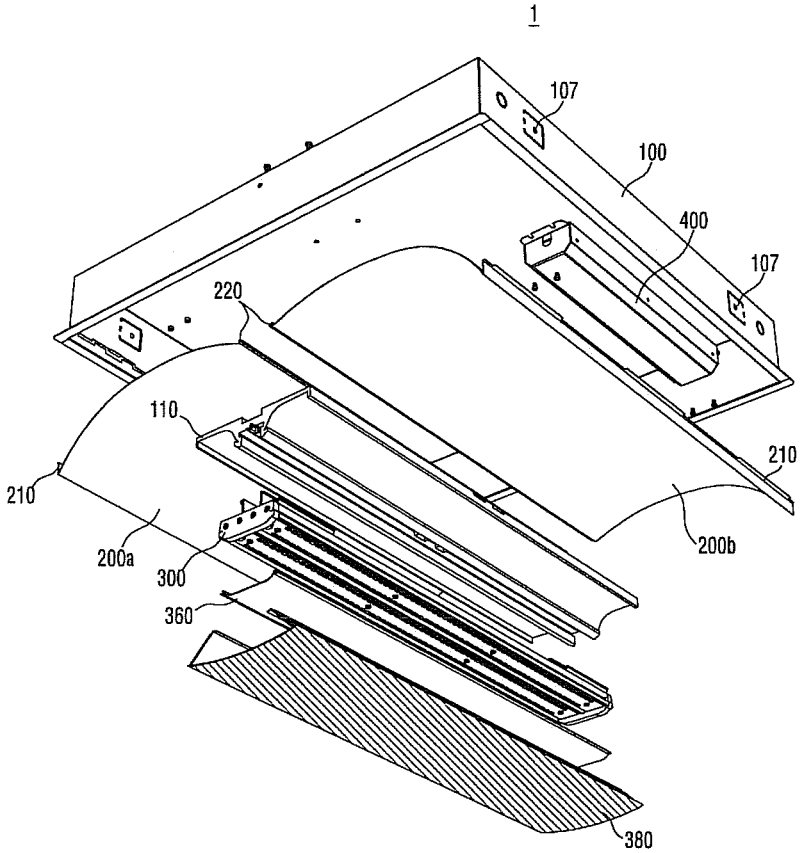
FIG. 2 is an exploded perspective view of the lighting device according to the embodiment of the present invention.
Figure 3:
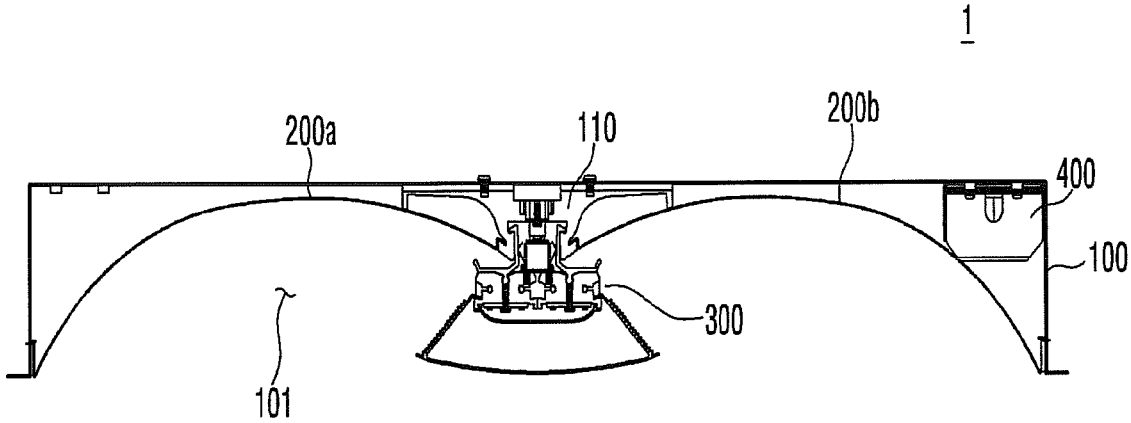
FIG. 3 is a cross sectional view of the lighting device according to the embodiment of the present invention.
Figure 4A:
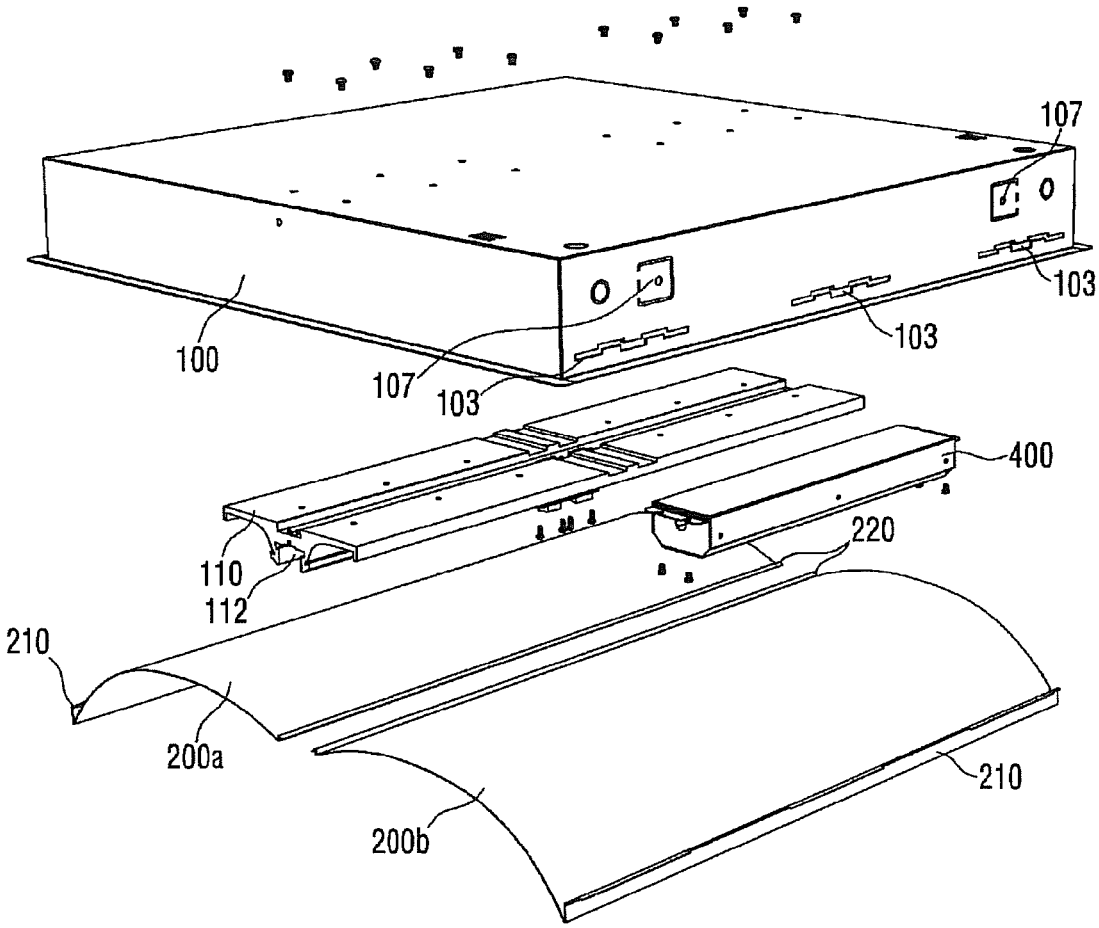
FIG. 4*a* is an exploded perspective view showing a housing, a reflector and a coupling member of FIG. 3.
Figure 4B:
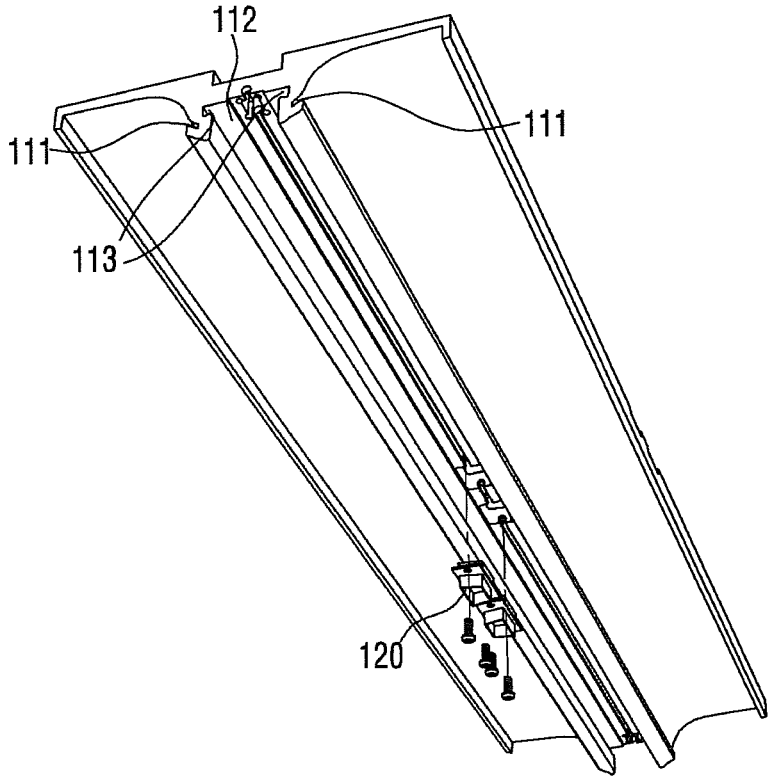
FIG. 4*b* is an exploded perspective view of the coupling member shown in FIG. 3.
Figure 4C:
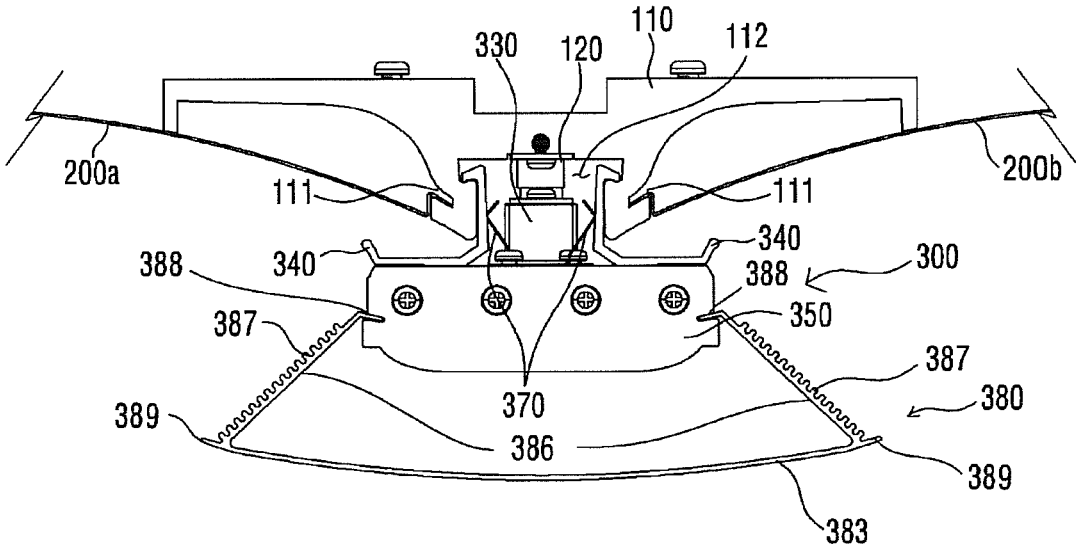
FIG. 4*c* is an enlarged view of the coupling member and a light source unit of FIG. 3.

FIG. 1 is a perspective view of a lighting device 1 according to an embodiment of the present invention. FIG. 2 is an exploded perspective view of the lighting device 1 according to the embodiment of the present invention. FIG. 3 is a cross sectional view of the lighting device 1 according to the embodiment of the present invention. FIG. 4*a* is an exploded perspective view showing a housing, a reflector and a coupling member of FIG. 3. FIG. 4*b* is an exploded perspective view of the coupling member shown in FIG. 3. FIG. 4*c* is an enlarged view of the coupling member and a light source unit of FIG. 3.

Referring to FIGS. 1 to 4*c*, a lighting device 1 in accordance with an embodiment of the present invention includes a housing 100, a coupling member 110, a reflector 200, a light source unit 300 and a power supply unit 400.

1. Housing 100 and Coupling Member 110

The housing 100 may have a shape of a box for accepting the coupling member 110 and the reflector 200. While the shape of the housing 100 as viewed from the outside may be quadrangular, the housing 100 may have various shapes without being limited to this.

The housing may be formed of a material which can efficiently release heat. For example, the housing 100 may be formed of a metallic material such as Al, Sn, Ni, Ag, Cu, Ti, Mo, W, Au and Pt and the like.

A hole 107 connecting electrically the power supply unit 400 to an external power supply may be formed on the lateral surface and/or upper surface of the housing 100. The power supply unit 400 which is electrically connected to an external power supply and controls the electric power supply to the light source unit 300 may be disposed on the lateral surface and/or upper surface of the housing 100.

The housing 100 includes an opening 101 allowing light emitted from the light source unit 300 to be reflected by the reflector 200 and is emitted.

Meanwhile, in a case where the lighting device 1 is installed on an external support member such as a ceiling or a wall, an insertion portion corresponding to the shape of the lighting device 1 is formed in the external support member, and then the lighting device 1 is inserted into and fixed to the insertion portion.

The coupling member 110 may be coupled to the inner upper surface of the housing 100. The coupling member 110 may be coupled to the housing 100 in various ways. For example, the coupling member 110 may be coupled to the housing 100 by using a coupling screw, an adhesive and the like.

The coupling member 110 may be formed extending in a first direction on the inner upper surface of the housing 100. For example, the coupling member 110 may be formed extending from one inner wall of the housing 100 to the opposite inner wall of the housing 100.

The reflector 200 is disposed inside the housing 100 and includes a first side 210 and a second side 220. The first side 210 is attached and fixed to the side of the housing 100. The second side 220 is attached and fixed to the side of the coupling member 110.

A first groove 111 may be formed o the outer wall of the coupling member 110. The first groove 111 may be formed extending in the first direction. The second side 220 of the reflector 200 may be inserted into the first groove 111.

The housing 100 and the coupling member 110 may be formed such that the reflector 200 may be attachable thereto and removable therefrom.

A second groove 103 may be formed on the inner wall of the housing 100. The first side 210 of the reflector 200 may be inserted into the second groove 103. It is possible to form the one second groove 103 or a plurality of the second grooves 103.

The first side 210 of the reflector 200 is inserted into the second groove 103 of the housing 100, and the second side 220 of the reflector 200 is inserted into the first groove 111 of the coupling member 110. As a result, the housing 100 and the coupling member 110 are able to fix and sustain the reflector 200.

Also, the coupling member 110 may be formed such that the light source unit 300 may be attachable thereto and removable therefrom.

An insertion groove 112 may be formed in the middle portion of the coupling member 110. A portion of the light source unit 300 may be inserted into the insertion groove 112. The insertion groove 112 may be formed extending in the first direction.

A third groove 113 may be formed on the inner wall of the insertion groove 112. A connection member 340 of the light source unit 300 may be inserted into the third groove 113. As a result, the light source unit 300 can be securely coupled to the coupling member 110 by the third groove 113. The coupling of the light source unit 300 and the coupling member 110 will be described later in more detail.

A first connection terminal 120 may be formed in the middle portion within the insertion groove 112. When the light source unit 300 is inserted into the insertion groove 112, the first connection terminal 120 may be coupled to and electrically connected to a second connection terminal 330 of the light source unit 300. When the first connection terminal 120 is connected to the second connection terminal 330, electric power and/or a driving signal can be transmitted to the light source unit 300 through the first connection terminal 120 and the second connection terminal 330.

Based on the design of the lighting device 1, it is possible to form the one first connection terminal 120 or a plurality of the first connection terminals 120. More detailed description of the first connection terminal 120 will be provided later together with the detailed description of the second connection terminal 330.

The coupling member 110 also performs a function of directly radiating heat generated from the light source unit 300 or transferring the heat to the housing 100.

It is recommended that the coupling member 100 is formed of a material capable of efficiently radiating and/or transferring the heat. For example, the coupling member 110 may be formed of a metallic material such as Al, Sn, Ni, Ag, Cu, Ti, Mo, W, Au and Pt and the like.

2. Reflector 200

The reflector 200 may include a first reflector 200*a* and a second reflector 200*b*. The first reflector 200*a* and the second reflector 200*b* are attachable to and removable from the housing 100 and the coupling member 110.

For example, as shown in FIG. 2, the second reflector 200*b* may be coupled to the housing 100 and the coupling member 110 by inserting the second side 220 of the second reflector 200*b* into the first groove 111 of the coupling member 110 and by inserting the first side 210 of the second reflector 200*b* into the second groove 103 of the housing 100.

The second side 220 of the reflector 200 may be formed to have a level difference. The first side 210 of the reflector 200 may be also formed to have a level difference. At least one insertion end may be formed on the first side 210. At least one insertion end which may be inserted into the second groove 103 may be formed on the first side 210 of the reflector 200. The shape of the second groove 103 may be formed corresponding to that of the selection end.

The first reflector 200*a* and the second reflector 200*b* may have a parabola-shaped surface and may be formed extending in the first direction. Therefore, the first reflector 200*a* and the second reflector 200*b* may form a parabolic shape having two paraboloids. Here, the shape of the reflector 200 can be variously changed according to a desired lighting.

The reflector 200 may be formed of a metallic material or a resin material which has high reflection efficiency. For example, the resin material includes any one of PET, PC and PVC resin. The metallic material includes any one of Ag, alloy including Ag, Al, and alloy including Al.

The surface of the reflector 200 may be coated with Ag, Al, white photo solder resist (PSR) ink, a diffusion sheet and the like. Otherwise, an oxide film may be formed on the surface of the reflector 200 by an anodizing process.

Here, the material and color of the reflector 200 are not limited and are variously selected depending on a lighting generated by the lighting device 1.

3. Power Supply Unit 400

When the power supply unit 400 is connected to the light source unit 300, the power supply unit 400 can supply at least one of electric power and a driving signal.

As shown in FIGS. 2 and 3, the power supply unit 400 may be disposed in a space between the parabola-shaped reflector 200 and the inner surface of the housing 100. That is, due to the parabola shape of the reflector 200, an empty space may be formed between the reflector 200 and the corner inside the housing 100. As a result, the power supply unit 400 may be disposed in the empty space.

The power supply unit 400 can convert alternating current (AC) into direct current (DC) and output the direct current (DC).

The power supply unit 400 may be electrically connected to the light source unit 300 through a wire, a flexible printed circuit board (FPCB) or the like. For example, the wire or FPCB extends from the power supply unit 400 and is electrically connected to the first connection terminal 120 through the hole formed in the coupling member 110, and the first connection terminal 120 is electrically connected to the second connection terminal 330. As a result, the power supply unit 400 is electrically connected to the light source unit 300.

4. Light Source Unit 300

The lighting device 1 includes the light source unit 300. The light source unit 300 may be, as shown in FIG. 1, disposed in the inner center of the housing 100. The light source unit 300 may be also coupled to the coupling member 110 in an attachable and removable manner.

Figure 5:
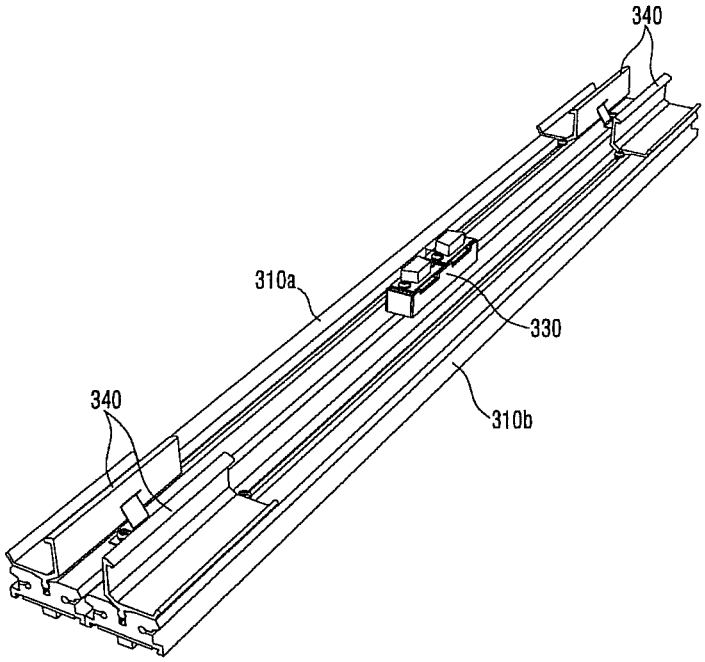
FIGS. 5 and 6 are perspective views of the light source unit according to the embodiment.
Figure 6:
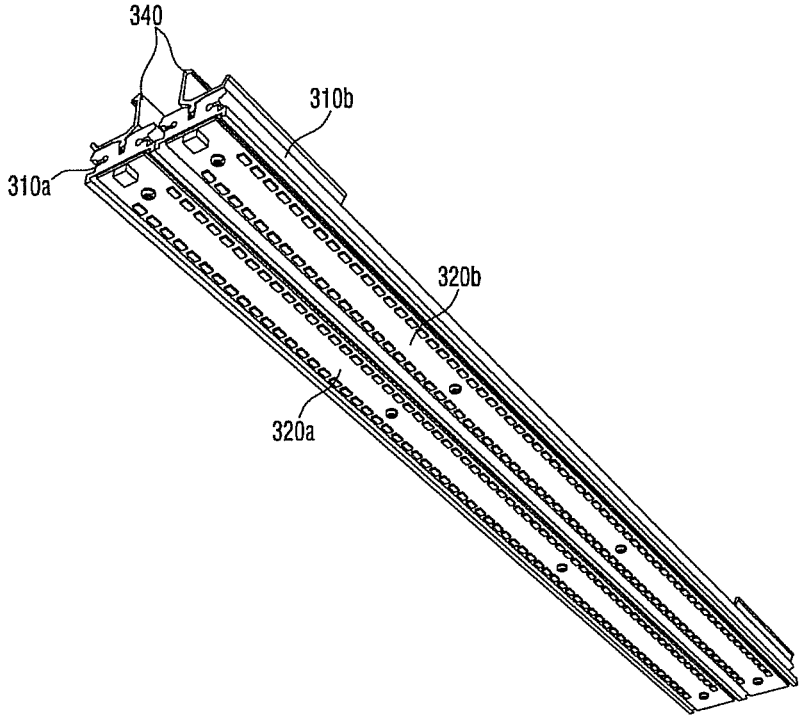
Figure 7:
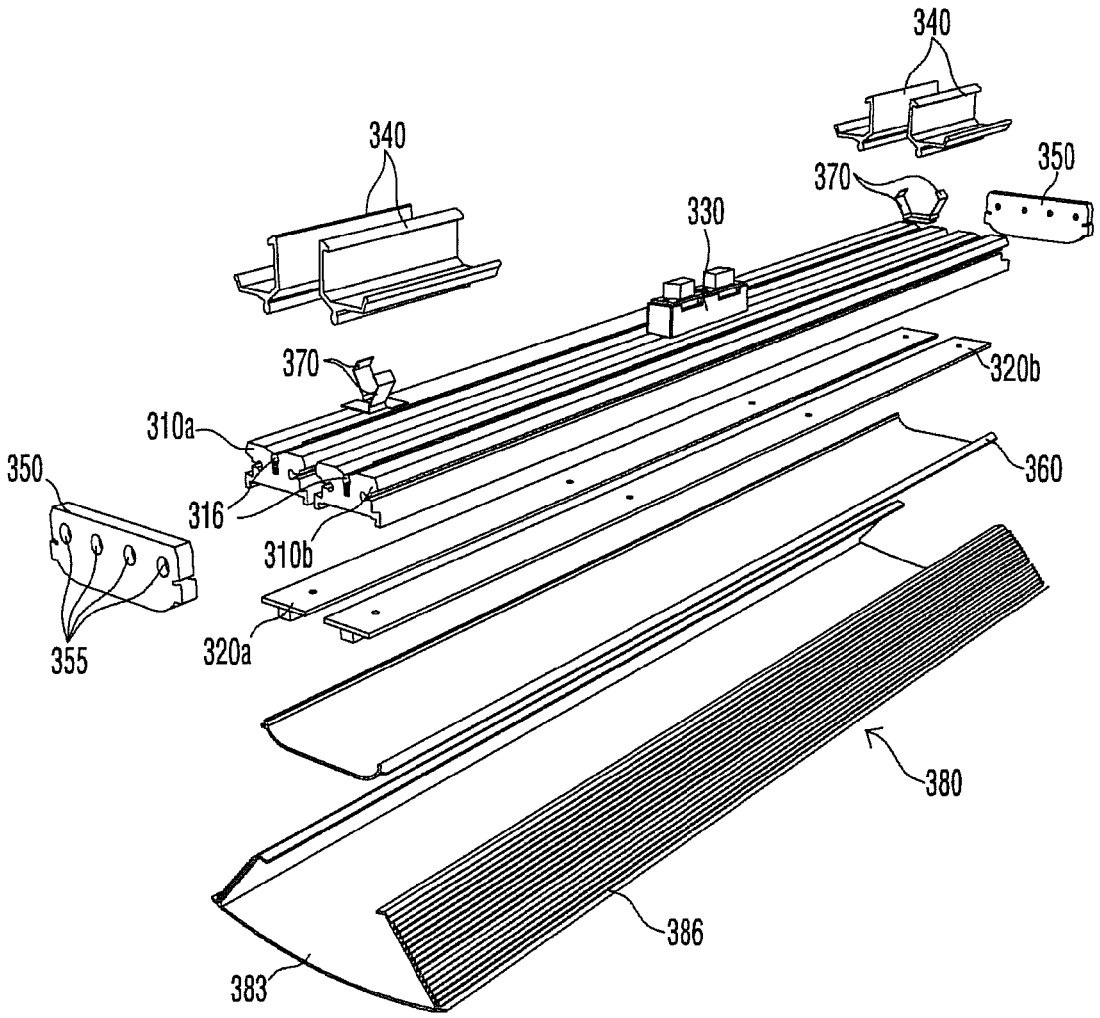
FIGS. 7 and 8 are exploded perspective views of the light source unit according to the embodiment.
Figure 8:
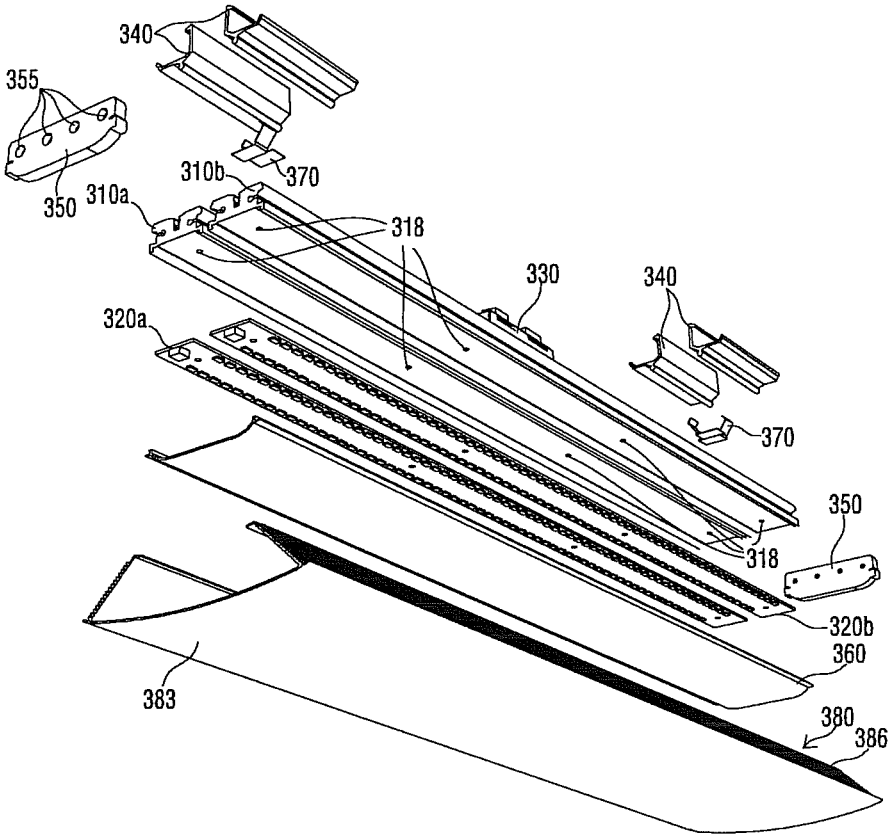
Figure 9A:
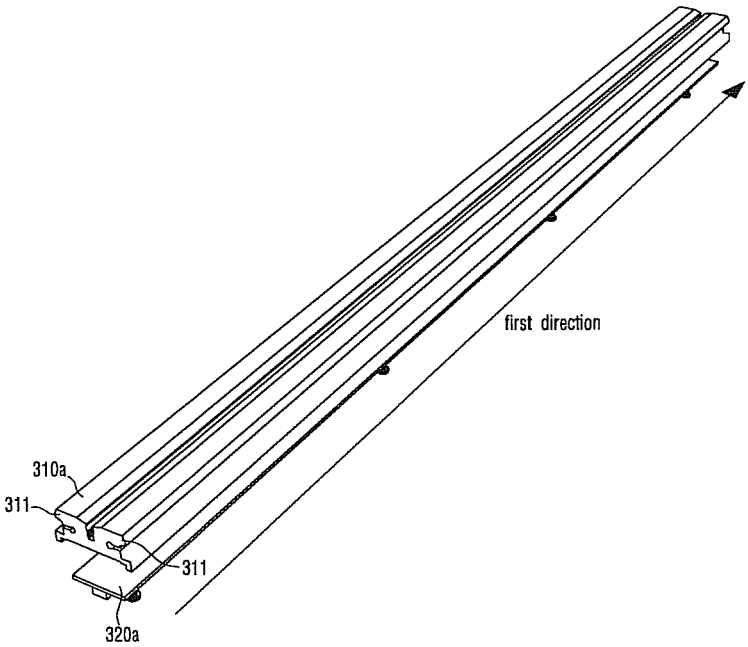
FIG. 9*a* is an exploded perspective view of a body unit of the lighting device according to the embodiment.
Figure 9B:
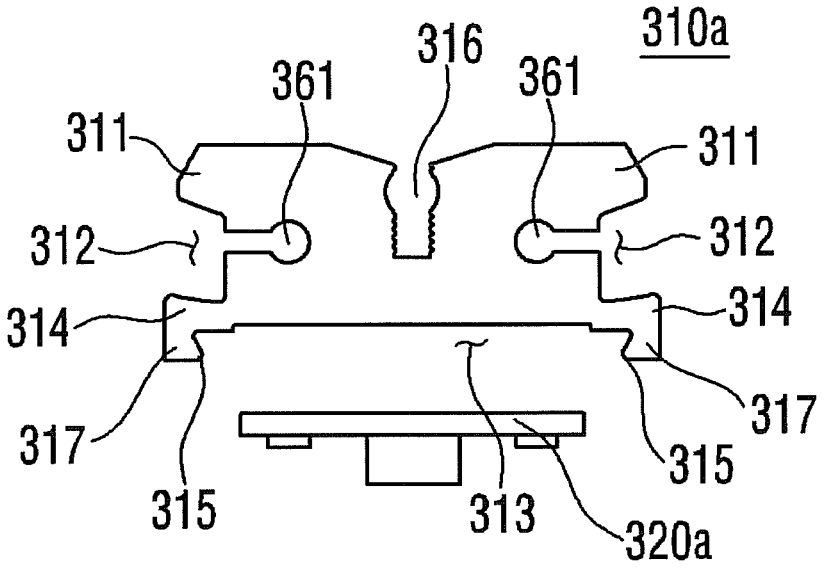
FIG. 9*b* is an exploded cross sectional view of the body unit of the lighting device according to the embodiment.
Figure 9C:
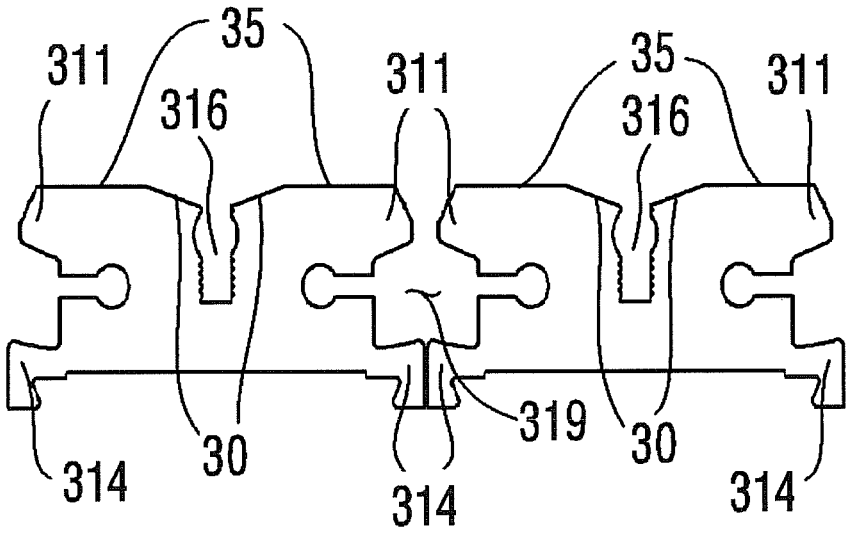
FIG. 9*c* is a cross sectional view of the plural bodies according to the embodiment.
Figure 10:
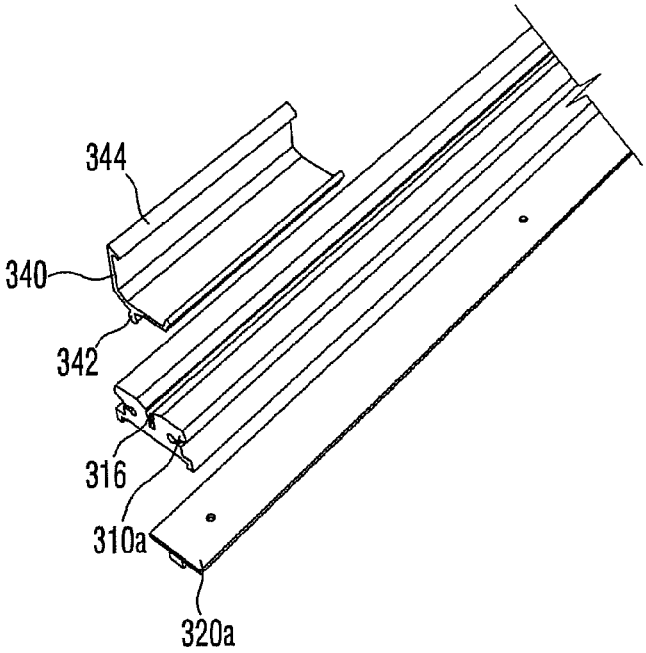
FIG. 10 is an exploded perspective view of a connection member and the body unit of the lighting device according to the embodiment.

FIGS. 5 and 6 are perspective views of the light source unit 300 according to the embodiment. FIGS. 7 and 8 are exploded perspective views of the light source unit 300 according to the embodiment. FIG. 9*a* is an exploded perspective view of a body unit of the lighting device according to the embodiment. FIG. 9*b* is an exploded cross sectional view of the body unit of the lighting device according to the embodiment. FIG. 9*c* is a cross sectional view of the plural bodies of the lighting device according to the embodiment. FIG. 10 is an exploded perspective view of the connection member and the body unit of the lighting device according to the embodiment.

Referring to FIGS. 5 to 10, the light source unit 300 according to the embodiment includes a first body 310*a*, a second body 310*b*, a first light emitting module 320*a*, a second light emitting module 320*b*, the second connection terminal 330, the connection member 340, a protective cover 360 and an optical cover 380.

The first body 310*a* and the second body 310*b* have the same shape and form the body unit of the light source unit 300. The light source unit 300 may be formed extending in the first direction, that is, in the longitudinal direction of the reflector 200.

1) First Body 310*a* and Second Body 310*b*

The light source unit 300 includes the first body 310*a* and the second body 310*b* in which the first light emitting module 320*a* and the second light emitting module 320*b* are disposed respectively. The first body 310*a* and the second body 310*b* may be designated as the body unit or a light source body.

The first body 310*a* and the second body 310*b* may have a shape shown in FIGS. 7 to 9*c*. Since the first body 310*a* and the second body 310*b* have the same shape, the shape will be described below on the basis of the first body 310*a*.

As shown in FIG. 9*a*, the first body 310*a* may have a straight beam shape extending in the first direction from one end to the other end thereof. The first direction may be randomly selected as the direction of one of straight lines parallel with the lighting surface of the lighting device 1.

FIG. 9*b* is a cross sectional view formed by cutting the first body 310*a* of FIG. 9*a* along a plane perpendicular to the first direction. In the cross section of the first body 310*a*, the first body 310*a* may include a first projection 311, a second projection 314 and a lower projection 317. The first projection 311 projects outwardly from both upper sides of the first body 310*a*. The second projection 314 projects outwardly from both lower sides of the first body 310*a*. The lower projection 317 projects downwardly from both ends of the bottom surface of the first body 310*a*.

According to the cross sectional view, the lower projection 317 is formed parallel with the first direction from the both ends of the bottom surface of the first body 310*a*. Additionally, a seating surface 313 in which the first light emitting module 320*a* is disposed may be formed between the lower projections 317.

As shown in FIG. 9*b*, the first body 310*a* may have a symmetrical shape, and therefore, a member like the first body 310*a* can be used without distinction of right and left. The right side and left side of the first body 310*a* may include the second projection 314 for catching the optical cover 380.

In order that the optical cover 380 is more stably coupled to the first body 310*a*, the second projection 314 may be inclined closer to the top surface of the first body 310*a* the farther it is from the first body 310*a*.

The right side and left side of the first body 310*a* may also include a side groove 312 between the first projection 311 and the second projection 314. When the first body 310*a* and the second body 310*b* are arranged in parallel with the each other such that the sides of the first body 310*a* and the second body 310*b* face each other, the side groove 312 functions as an electrical connection path through which a wire coming from the first light emitting module 320*a* and the second light emitting module 320*b* passes.

FIG. 9*c* is a cross sectional view when the sides of the plural bodies are arranged to face each other. As shown in FIG. 9*c*, a wire path 319 may be formed between the plural bodies by the first projection 311 and the second projection 314.

The wire connected to the first light emitting module 320*a* and the second light emitting module 320*b* so as to receive electric power from an external power supply is disposed within the wire path 319 and can be connected to the second connection terminal 330.

The first projection 311 disposed on the top surface of the body unit may be formed shorter than the second projection 314 in order that the path allowing the wire to be connected to and come from the second connection terminal 330 disposed on the top surfaces of the first body 310*a* and the second body 310*b* is obtained.

The first projection 311 is formed shorter than the second projection 314. Accordingly, when the first body 310*a* and the second body 310*b* are arranged in parallel with each other and the second projections 314 of the first body 310*a* and the second body 310*b* contact with each other, the first projections 311 between the first and the second bodies 310*a* and 310*b* do not contact with each other and are spaced apart from each other at a predetermined interval.

The bottom surface of the first body 310*a* includes the seating surface 313 in which the first light emitting module 320*a* is seated. A substrate may be disposed on the seating surface 313. A plurality of light emitting diodes may be disposed on the substrate. The light emitting diodes may receive electric power through the substrate.

The plurality of the light emitting diodes may be selected, for example, through various combinations of red, green, blue and white light emitting diodes which radiate red, green, blue and white light respectively. The plurality of the light emitting diodes may be arranged in the form of an array.

An optical structure is disposed on the plurality of the light emitting diodes. The optical structure may adjust the light distribution and the color sense of light emitted from the plurality of the light emitting diodes, and may create emotional lighting having various luminance and color senses if necessary.

The seating surface 313 of the first body 310*a* includes plural tap holes 318 which are separated from each other at a predetermined interval. The first light emitting module 320*a* also includes screw holes corresponding to the positions of the tap holes 318 of the seating surface 313 of the first body 310*a*. Additionally, a screw thread for screw-coupling may be formed in at least some of the tap holes 318.

Accordingly, screws pass through the screw holes of the first light emitting module 320*a* and are coupled to the tap holes 318 of the first body 310*a*, so that the first light emitting module 320*a* can be fixed to the seating surface 313 of the first body 310*a*.

An inward locking projection 315 is disposed on both ends of the bottom surface of the first body 310*a*. Here, the side of the protective cover 360 is inserted and fixed into the locking projection 315, so that the protective cover 360 is fixed to the first body 310*a*.

The first body 310*a* functions as a heat sink. The bottom surface of the first body 310*a* functions as a contact surface receiving heat generated from the first light emitting module 320*a*.

The top surface of the first body 310*a* includes a connection groove 316 extending from one end to the other end of the first body 310*a*. The upper portion of the connection groove 316 may be formed corresponding to the shape of a connection portion 342 of the connection member 340 in such a manner that the connection member 340 is fixed and connected to the connection groove 316. The lower portion of the connection portion 316 has a screw thread such that the first body 310*a* is directly connected to the housing 100 by means of a screw and the like.

The connection groove 316 of the top surface of the first body 310*a* is formed extending from one end to the other end of the first body 310*a*. As a result, it is possible to reduce the manufacturing cost and weight of the first body 310*a* and to freely select where the connection member 340 is attached to the first body 310*a* if necessary. Besides, even when the first body 310*a* is directly coupled to the housing 100 by means of a screw and the like, it is also possible to freely select where the screw is coupled.

Contrarily to this, as described above, the tap holes 318 are discretely formed in the bottom surface of the first body 310*a*. This intends to increase a contact area with the first light emitting module 320*a* such that the first body 310*a* efficiently functions as a heat sink.

Accordingly, the plural tap holes 318 which are mutually separated may be formed in the bottom surface of the first body 310*a*, and the connection groove 316 may be formed in the top surface of the first body 310*a* in such a manner as to extend from one end to the other end of the first body 310*a*.

As shown in FIG. 9*c*, the top surface of the first body 310*a* may include a first surface 30 and a second surface 35. The first surface 30 is directly connected to the connection groove 316. The second surface 35 extends from the first surface 30 to the outside of the first body 310*a*.

When a distance from the bottom surface to the top surface of the first body 310*a* is designated as a height, the height to the first surface 30 may become less toward the connection groove 316, and the height to the second surface 35 may be horizontal and uniform.

In a case where the top surface of the first body 310*a* is horizontal, when the first body 310*a* is screw-coupled to the inner upper surface of the housing 100 through the connection groove 316, only the portion where the connection groove 316 is formed closely contacts with the inner upper surface of the housing 100, and the outer portion of the top surface of the first body 310*a* may not closely contact with the inner upper surface of the housing 100.

Contrarily, in a case where the height to the first surface 30 of the top surface of the first body 310*a* becomes less toward the connection groove 316 and the height to the second surface 35 of the top surface of the first body 310*a* is horizontal and uniform, as a screw is tightened, the first surface 30 in which the connection groove 316 is disposed comes in close contact with the inner upper surface of the housing 100, and then the second surface 35, i.e., the outer portion of the top surface, also comes in close contact with the inner upper surface of the housing 100. Accordingly, a contact area of the housing 100 and the first body 310*a* becomes greater, so that excellent thermal conductivity and the like can be obtained.

2) Connection Member 340 and Coupling Cap 350

The connection member 340 includes a first connection member and a second connection member, both of which are disposed on the first and the second bodies 310*a* and 310*b* respectively. The connection member 340 is disposed in the connection grooves 316 of the surfaces of the first and the second bodies 310*a* and 310*b* and is caught and fixed to the third groove 113 of the coupling member 110. Therefore, the connection member 340 functions to attach and fix the light source unit 300 to the coupling member 110.

The connection member 340 includes the connection portion 342 which has a shape corresponding to the shape of the upper portion of the connection groove 316 in such a manner that the connection member 340 is attached and fixed to the connection grooves 316 of the first and the second bodies 310*a* and 310*b*. The connection member 340 also includes a coupling projection 344 such that the connection member 340 is caught and fixed to the third groove 113 of the coupling member 110.

The connection member 340 may be inserted and fixed to the upper portion of the connection grooves 316 of the first and the second bodies 310*a* and 310*b* in a sliding manner. Since the connection grooves 316 of the first and the second bodies 310*a* and 310*b* extend from one end to the other end of the first and the second bodies 310*a* and 310*b* respectively, the connection member 340 slides with the fixing to the connection groove 316 and then may be disposed at a desired position of the top surfaces of the first and the second bodies 310*a* and 310*b*.

A spring 370 may be disposed between the vertical planes of the connection member 340, in other words, between the first connection member and the second connection member. For example, as shown in FIGS. 7 and 8, the spring 370 may have a 'V'-shape of which the lower portion is flat and may be disposed contacting with the vertical planes of the connection member 340 and the top surfaces of the first and the second bodies 310*a* and 310*b*.

The spring 370 is able to cause the light source unit 300 to be securely coupled to the insertion groove 112 of the coupling member 110 by providing an elastic force to the vertical plane of the connection member 340. The spring 370 may provide the vertical plane of the connection member 340 with the elastic force widening the interval between the vertical planes of the connection member 340, that is, an interval between the first connection member and the second connection member.

In other words, the spring 370 performs a function of pushing outward the vertical planes of the connection member 340. Therefore, when the light source unit 300 is inserted into the coupling member 110, the connection member 340 coupled to the surfaces of the first and the second bodies 310*a* and 310*b* may be securely coupled to the third groove 113 of the coupling member 110 by the force from the spring 370.

Heat generated from the plurality of the light emitting diodes is radiated by the body of the light source unit 300 or is transferred to the coupling member 110 through the connection member 340 connecting the first and the second bodies 310*a* and 310*b* to the coupling member 110, and is radiated. Thus, it is recommended that the first body 310*a* and the second body 310*b* are formed of a material capable of effectively radiating the heat.

For example, the first body 310*a* and the second body 310*b* may be formed of a metallic material such as Al, Sn, Ni, Ag, Cu, Ti, Mo, W, Au and Pt and the like. Additionally, a portion of the light source unit 300 has an uneven structure capable of effectively radiating the heat.

The first body 310*a* and the second body may be coupled to each other by coupling a coupling cap 350 to one ends of the first and the second bodies 310*a* and 310*b*.

As shown in FIG. 9*b*, a first groove 361 may be formed in one side of the first and the second bodies 310*a* and 310*b*.

Referring to FIGS. 7 and 8, the coupling cap 350 may include a through-hole 355 formed at a position corresponding to the first groove 361. Screws pass through the through-holes 355 of the coupling cap 350 and are coupled to the first grooves 361. As a result, the coupling cap 350 is fixed to at least one ends of the first and the second bodies 310*a* and 310*b*, so that the first and the second bodies 310*a* and 310*b* can be coupled to each other.

3) First Connection Terminal 120 and Second Connection Terminal 330

As shown in FIGS. 4*b* and 4*c*, the first connection terminal 120 for electrical connection to the light source unit 300 may be disposed on the central portion of the coupling member 110. The first connection terminal 120 may be electrically connected to the power supply unit 400 by means of a wire and the like.

As shown in FIGS. 7 and 8, the second connection terminal 330 may be disposed on the first and the second bodies 310*a* and 310*b* in order to supply electric power to the light source unit 300.

A wire connected to the first light emitting module 320*a* and a wire connected to the second light emitting module 320*b* pass through a space between the first and the second bodies 310*a* and 310*b* and may be connected to the second connection terminal 330 disposed on the central portion of the top surface of the first and the second bodies 310*a* and 310*b*.

As such, the space formed by both the side groove 312 of the first body 310*a* and the side groove 312 of the second body 310*b* functions as a space where the wire is placed. Therefore, this makes it easier to arrange the wire for electrical connection.

When the light source unit 300 is inserted into the coupling member 110, the second connection terminal 330 is coupled to the first connection terminal 120 formed in the insertion groove 112 of the coupling member 110. Accordingly, the light source unit 300 can be electrically connected.

As a result, the power supply unit 400 may supply electric power and/or a driving signal to the light source unit 300 through the first connection terminal 120 and the second connection terminal 330.

The first connection terminal 120 and the second connection terminal 330 may be a D-sub connector. In this case, if the first connection terminal 120 includes a pin, the second connection terminal 330 includes a hole, and vice versa. Therefore, the first connection terminal 120 and the second connection terminal 330 may be electrically and physically connected to each other.

4) Optical Cover 380

The optical cover 380 is coupled to the side of the body unit comprised of the first and the second bodies 310*a* and 310*b*. The optical cover 380 may be disposed under the first and the second bodies 310*a* and 310*b* and may function as an optical member.

The optical cover 380 may be comprised of a first surface 383 and a second surface 386. The first surface 383 is a bottom surface of the optical cover 380 and faces the light emitting directions of the first light emitting module 320*a* and the second light emitting module 320*b*, both of which are disposed on the bottom surfaces of the first and the second bodies 310*a* and 310*b* respectively. The second surface 386 is a lateral surface of the optical cover 380 and connects the body unit with the first surface 383 and faces the reflector 200.

An inward catching projection 388 may be formed in the upper portion of the second surface 386 of the optical cover 380. The catching projection 388 is disposed on the second projection 314 formed on the sides of the first and the second bodies 310*a* and 310*b*, so that the optical cover 380 can be coupled to the body unit.

At least a part of light emitted from the first light emitting module 320*a* and the second light emitting module 320*b* may be reflected by the first surface 383 of the optical cover 380 and may pass through the second surface 386. The light which has passed through the second surface 386 is reflected by the reflector 200 and is emitted to the downside of the housing 100.

The transmittance of the second surface 386 may be greater than that of the first surface 383. Protrusions 387 may be formed on the second surface 386 and are capable of uniformly diffusing the light passing through the second surface 386. The light dispersed by passing through the protrusion 387 is uniformly irradiated and the uniform light may be emitted to the outside of the lighting device 1.

That is, the light emitted from the first light emitting module 320*a* and the second light emitting module 320*b* not only irradiates a lighting area as direct light by transmitting through the first surface 383 of the optical cover 380 but also irradiates a lighting area as indirect light by being reflected by the first surface 383 of the optical cover 380 and the reflector 200. As described, the lighting device 1 is able to provide indirect light as well as direct light.

An extension part 389 may be formed extending and projecting from the first surface 383 at a portion formed by the contact of the first surface 383 and the second surface 386. The extension part 389 may be used as a handhold for bending the optical cover 380 at the time of coupling the optical cover 380 to the body unit and may function to prevent users under the lighting device 1 from seeing the protrusions 387 of the second surface 386. For this purpose, the extension part 389 is formed higher than the protrusion 387 and the protrusion 387 is not visible to the users.

The protective cover 360 may be disposed between the body unit and the optical cover 380. The protective cover 360 is able to protect the first light emitting module 320*a* and the second light emitting module 320*b* from moisture and the like which may be introduced into the light source unit 300.

The protective cover 360 may also function as an optical member. The protective cover 360 is capable of perform a function of uniformly dispersing the light emitted from the first light emitting module 320*a* and the second light emitting module 320*b*.

The protective cover 360 and/or the optical cover 380 may include at least one of a lens, a diffusion sheet and a phosphor luminescent film (PLF). The lens may include various lenses such as a concave lens, a convex lens and a condensing lens and so on according to a design of the lighting device.

The diffusion sheet is capable of uniformly diffusing the light emitted from the plurality of the diodes.

The phosphor luminescent film (PLF) may include a fluorescent material. Since the fluorescent material included in the phosphor luminescent film (PLF) is excited by light emitted from the first light emitting module 320*a* and the second light emitting module 320*b*, the lighting device can create emotional lighting having various color senses by mixing first light emitted from the first light emitting module 320*a* and the second light emitting module 320*b* and second light excited by the fluorescent material.

For example, when the first light emitting module 320*a* and the second light emitting module 320*b* emit blue light and the phosphor luminescent film (PLF) includes a yellow fluorescent material excited by blue light, the lighting device emits white light by mixing the blue light and yellow light.

The protective cover 360 and/or the optical cover 380 may be easily replaced by any one of a lens, a diffusion sheet and a phosphor luminescent film (PLF).

5. Coupling and Separation of Light Source Unit 300 and Coupling Member 110

1) Coupling Process

The light source unit 300 is attachable to and removable from the coupling member 110.

First, an interval between the first connection member and the second connection member of the connection member 340 is reduced by applying a first force to the connection member 340 disposed on the first and the second bodies 310*a* and 310*b* of the light source unit 300. Here, the direction of the first force may be reverse to the direction of the elastic force applied by the spring 370.

If the first force is not applied, the interval between the first connection member and the second connection member of the connection member 340 is great by the elastic force from the spring 370, so that it is difficult to insert the light source unit 300 into the insertion groove 112 of the coupling member 110.

The light source unit 300 is inserted into the insertion groove 112 of the coupling member 110 by applying the first force to the connection member 340. After the connection member 340 is inserted into the insertion groove 112, the first force is stopped from being applied. Then, the interval between the first connection member and the second connection member of the connection member 340 is increased again, and then the coupling projection 344 of the connection member 340 disposed on the light source unit 300 may be inserted into the third groove 113 formed on the inner surface of the insertion groove 112. As a result, the light source unit 300 is inserted into the coupling member 110.

After the light source unit 300 is coupled to the coupling member 110, the spring 370 disposed between the first connection member and the second connection member of the connection member 340 pushes out the first body 310*a* and the second body 310*b*, causing the connection member 340 to be securely coupled to the third groove 113.

Also, the spring 370 gives continuously a uniform pressure to a contact surface of the connection member 340 and the insertion groove 112. Accordingly, heat generated from the light source unit 300 may be efficiently transferred through the contact surface of the connection member 340 and the coupling member 110.

2) Separation Process

When the light source unit 300 is required to repair, the light source unit 300 may be separated from the coupling member 110.

In separating the light source unit 300 from the coupling member 110, after the interval between the first connection member and the second connection member of the connection member 340 is reduced by applying the first force to the connection member 340, the light source unit 300 is separated from the coupling member 110.

[Modified Embodiment]

Figure 11:
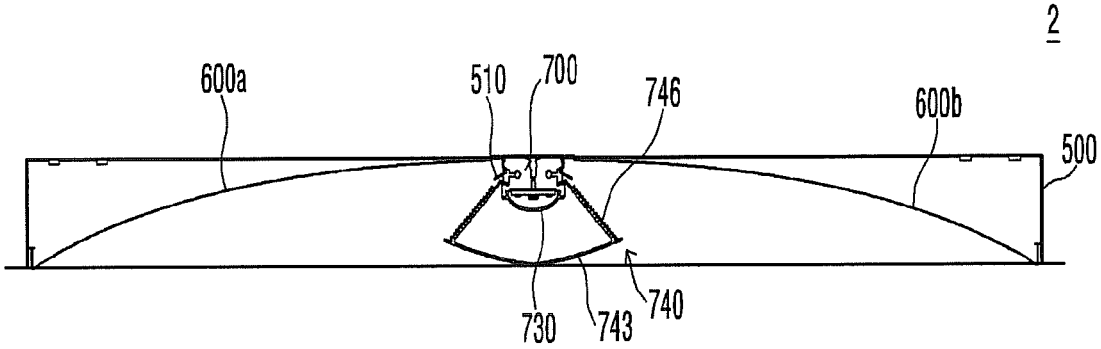
FIG. 11 is a cross sectional view of a lighting device according to a modified embodiment.
Figure 12:
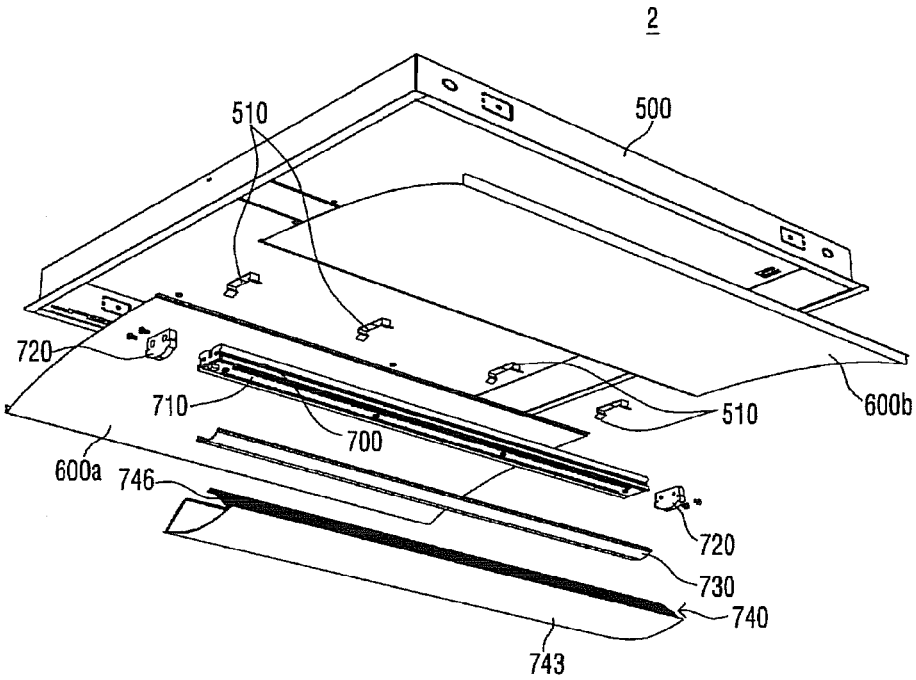
FIG. 12 is an exploded perspective view of the lighting device according to the modified embodiment.

FIG. 11 is a cross sectional view of a lighting device 2 according to a modified embodiment. FIG. 12 is an exploded perspective view of the lighting device 2 according to the modified embodiment.

In description of the lighting device 2 according to the modified embodiment, repetitive descriptions thereof will be omitted.

Referring to FIGS. 11 and 12, the lighting device 2 may include a housing 500, a body unit 700 coupled to the housing 500, reflectors 600*a* and 600*b* disposed between the housing 500 and the body unit 700, a protective cover 730 coupled to the lower portion of the body unit 700 and an optical cover 740.

The reflectors 600*a* and 600*b* may include a first reflector 600*a* and a second reflector 600*b*. The inner surface of the housing 500 may be coated with a reflective material. Therefore, instead of disposing the reflectors 600*a* and 600*b*, the inner surface of the housing 500 is able to perform the function of the reflectors 600*a* and 600*b*.

A clip 510 is disposed on the inner upper surface of the housing 500 of the lighting device 2. The clip 510 may be coupled to the housing 500 in various manners. For example, the clip 510 may be coupled to the housing 500 by means of a coupling screw, an adhesive and the like.

The clip 510 includes an opening into which the body unit 700 is inserted. Both sides of the clip 510 include an extension projection to which one side of the reflector is coupled. The body unit 700 is inserted and fixed into the clip 510 through the opening of the clip 510. As a result, the body unit 700 is coupled to the housing 500.

The body unit 700 of the modified embodiment may have the same shape as that of the first body 310*a* or the second body 310*b* of the foregoing embodiment.

A light emitting module 710 may be disposed on the bottom surface of the body unit 700. A protective cap 720 may be coupled to the ends of the body unit. The protective cover 730 and the optical cover 740 may be disposed under the body unit 700.

Even though FIGS. 11 and 12 show that the clips 510 are arranged in a line and one body unit 710 is provided, the clips 510 may be arranged in plural lines a plurality of the body units 700 may be also provided.

A part of the light emitted from the light emitting module 710 is irradiated as direct light by the bottom surface 743 of the optical cover 740, and the other part of the light is reflected by the bottom surface 743 of the optical cover 740 and passes through a lateral surface 746 of the optical cover 740. The light which has passed through the lateral surface 746 is reflected by the reflectors 600*a* and 600*b* and is irradiated as indirect light.

Figure 13:
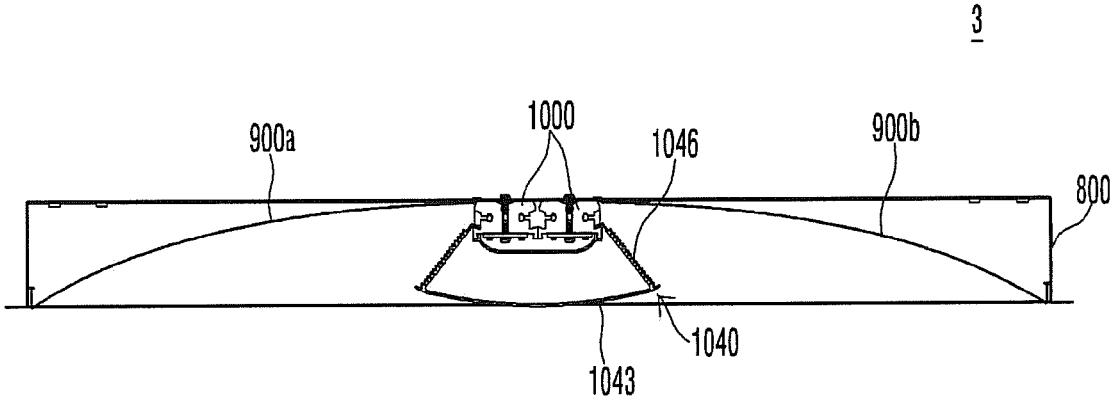
FIG. 13 is a cross sectional view of a lighting device according to another modified embodiment.
Figure 14:
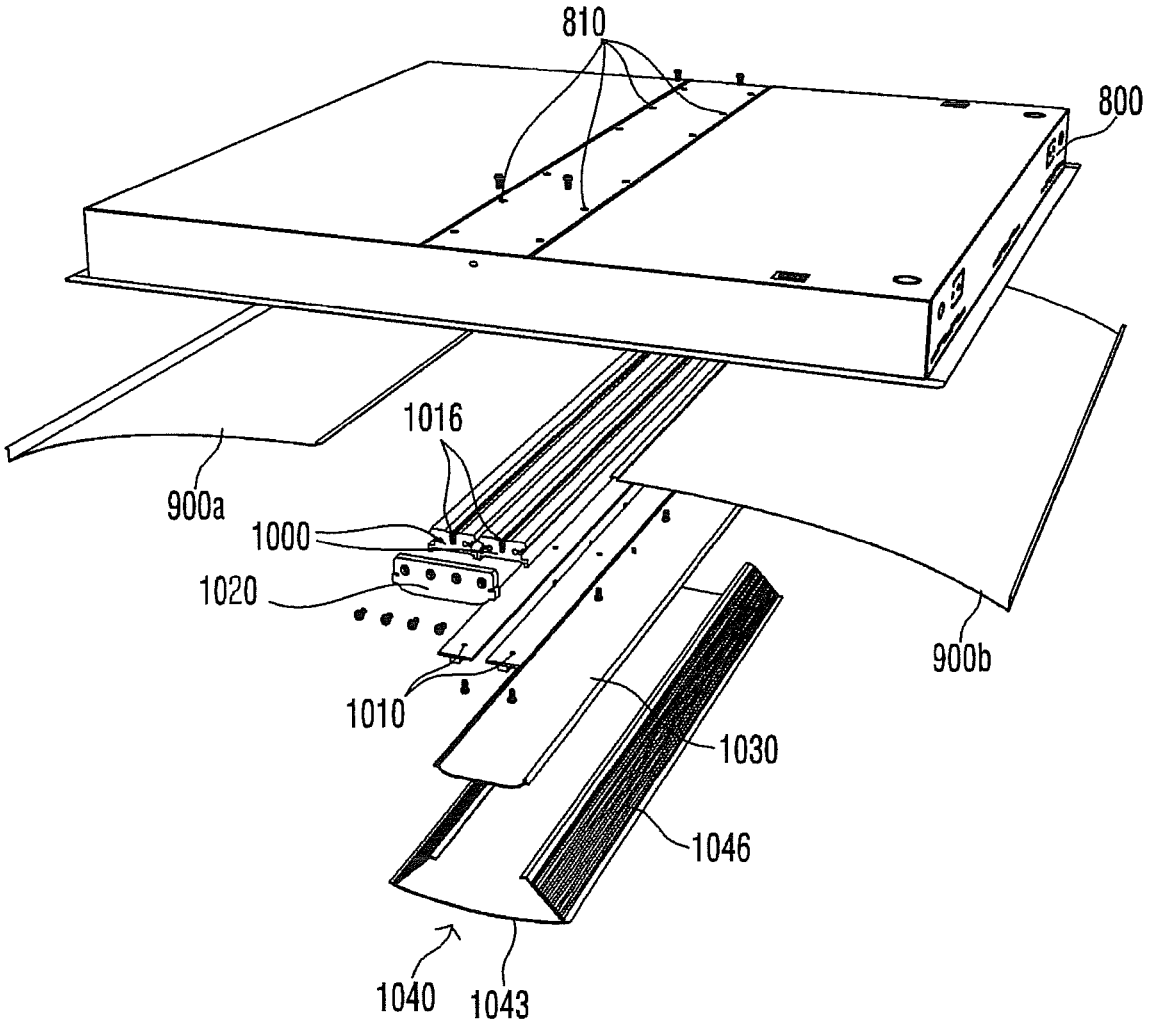
FIG. 14 is an exploded perspective view of the lighting device according to the another modified embodiment.

FIG. 13 is a cross sectional view of a lighting device 3 according to another modified embodiment. FIG. 14 is an exploded perspective view of the lighting device 3 according to the another modified embodiment.

Referring to FIGS. 13 and 14, an upper surface hole 810 is disposed in the inner upper surface of a housing 800 of the lighting device 3.

Each body of the body unit 1000 according to the another embodiment may have the same shape as that of the first body 310*a* or the second body 310*b* according to the embodiment. Although FIGS. 13 and 14 show that the body unit 1000 is formed by connecting two light source bodies, the number of the light source bodies is not limited and numbers of the light source bodies may be connected to each other.

A groove 1016 may be formed in the top surface of the body unit 1000 in such a manner as to extend from one end to the other end of the body unit 1000. A screw thread may be formed in the lower portion of the groove 1016.

The top surface of the body unit 1000 is disposed on the inner upper surface of the housing 800 in such a manner that the grooves 1016 of the body unit 1000 correspond to the upper surface holes 810 of housing 800. Screws pass through the upper surface holes 810 of housing 800 and are coupled to the grooves 1016 of the body unit 1000. Accordingly, the body unit 1000 can be fixed to the inner upper surface of the housing 800.

The coupling of the body unit 1000 and the housing 800 through the screw-coupling method causes the body unit 1000 to be tightly coupled to the housing 800. As a result, thermal conductivity can be improved by radiating more heat generated from the body unit 1000.

A light emitting module 1010 may be disposed on the bottom surface of the body unit 1000. A protective cap 1020 may be coupled to the side of the body unit 1000. A protective cover 1030 and an optical cover 1040 may be disposed under the body unit 1000.

The optical cover 1040 may include a bottom surface 1043 and a lateral surface 1046. The bottom surface 1043 faces the light emitting directions of the light emitting module 1010. The lateral surface 1046 faces the inner surface of the housing 800.

A part of the light emitted from the light emitting module 1010 is irradiated as direct light by the bottom surface 1043 of the optical cover 1040, and the other part of the light is reflected by the bottom surface 1043 of the optical cover 1040 and passes through a lateral surface 1046 of the optical cover 1040. The light which has passed through the lateral surface 1046 is reflected by the reflectors 900*a* and 900*b* and is irradiated as indirect light.

As described above, it will be appreciated by those skilled in the art that the present invention can be embodied in other specific forms without departing from its spirit or essential characteristics.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

The invention claimed is:

1. A lighting device comprising:

a housing;

a coupling member coupled to the housing;

a reflector disposed between the housing and the coupling member;

a light source unit connected to the coupling member; and an optical member connected to the light source unit, wherein the optical member transmits a part of light emitted from the light source unit and reflects the other part of the light to the reflector, wherein the light source unit comprises a body unit and a light emitting module disposed on the bottom surface of the body unit, wherein the body unit comprises a first body and a second body disposed on one side of the first body, wherein the light emitting module comprises a first light emitting module disposed on the first body and a second light emitting module disposed on the second body, and wherein the light source unit further comprises a coupling cap coupling the first body to the second body.

2. The lighting device of claim 1, wherein the optical member comprises a first surface disposed under the light source unit and a second surface connecting the light source unit with the first surface, wherein the first surface transmits and reflects the light emitted from the light source unit, and wherein the second surface transmits the light reflected from the first surface.

3. The lighting device of claim 2, wherein the second surface of the optical member comprises at least one projection.

4. The lighting device of claim 3, wherein the first surface comprises an extension part extending from both ends thereof, and wherein the extension part extends longer than the projection.

5. The lighting device of claim 1, further comprising a protective cover between the light source unit and the optical member, wherein the optical member and the protective cover comprise at least one of a lens, a diffusion sheet and a phosphor luminescent film (PLF).

6. The lighting device of claim 1, wherein the first body is symmetrical, wherein the first body comprises a first projection, a second projection and a lower projection, wherein the first projection projects outwardly from both upper sides of the first body, wherein the second projection projects outwardly from both lower sides of the first body, and wherein the lower projection projects downwardly from both ends of the bottom surface of the first body.

7. The lighting device of claim 6, wherein the second projection becomes closer to the top surface of the first body the farther it is from the first body.

8. The lighting device of claim 7, wherein the first projection is formed shorter in the side direction of the light source unit than the second projection.

9. The lighting device of claim 8, wherein a wire connected to the light emitting module is disposed in a wire path formed by the first projection and the second projection between the plural bodies.

10. The lighting device of claim 1, wherein the coupling member comprises an insertion groove, and wherein the light source unit further comprises a connection member coupled to the insertion groove of the coupling member.

11. The lighting device of claim 10, wherein the coupling member further comprises a first connection terminal in the insertion groove, wherein the light source unit further comprises a second connection terminal, and wherein the connection member of the light source unit is coupled to the insertion groove of the coupling member, so that the first connection terminal is electrically connected to the second connection terminal.

12. The lighting device of claim 10, wherein the light source unit comprises a body unit and a light emitting module, wherein the body unit comprises a first body and a second body, wherein the connection member comprises a first connection member disposed on the first body and a second connection member disposed on the second body, and wherein the lighting device further comprises a spring between the first connection member and the second connection member.

13. A lighting device comprising:

a housing which includes a coupler; and a light source unit which extends in one direction of the housing and is coupled to the housing by a coupler corresponding to the coupler of the housing, wherein the light source unit comprises at least one body unit and a light emitting module disposed on the bottom surface of the body unit, wherein the body unit comprises a first body and a second body disposed on one side of the first body, wherein the light emitting module comprises a first light emitting module disposed on the first body and a second light emitting module disposed on the second body, and wherein the light source unit further comprises a coupling cap coupling the first body to the second body.

14. The lighting device of claim 13, further comprising at least one reflector which is disposed between the housing and the light source unit, and further comprising an optical member which is coupled to the light source unit and transmits a part of light emitted from the light emitting module and reflects the other part of the light to the housing.

15. The lighting device of claim 13, wherein, when the coupler is a clip, the clip is disposed on the inner upper surface of the housing and has an opening, and wherein the light source unit is inserted into the opening of the clip and is coupled to the housing.

16. The lighting device of claim 13, wherein, when the coupler is a screw, at least one hole is formed on the top surface of the housing in one direction and at least one groove is formed on the top surface of the body unit, and wherein the screw passes through the hole of the housing and is coupled to the groove of the body unit, so that the light source unit is coupled to the housing.

17. The lighting device of claim 13, wherein the body unit comprises at least one body, and wherein the body is symmetrical, and wherein the lighting device further comprises a coupling cap coupling both sides of the bodies.

18. A lighting device comprising:

a housing;

a light source unit comprising a body unit disposed under the housing and a light emitting module disposed under the body unit; and a reflector disposed between the housing and the body unit, wherein the body unit comprises a first body including a first bottom surface and a second body including a second bottom surface, wherein the light emitting module comprises a first light emitting module disposed on the first bottom surface and a second light emitting module disposed on the second bottom surface.

19. The lighting device of claim 18, further comprising a coupling cap coupling both ends of the first body and the second body.

20. The lighting device of claim 18, further comprising a connection member disposed between the housing and the light source unit, wherein the first body includes a first top surface and the second body includes a second top surface, wherein the connection member comprises a first connection member disposed on the first top surface and a second connection member disposed on the second top surface, and wherein the lighting device further comprises a spring between the first connection member and the second connection member.

* * * * *